US012790159B2

(12) United States Patent
Hartgers et al.

(10) Patent No.: US 12,790,159 B2
(45) Date of Patent: Nov. 10, 2026

(54) HOLLOW TUBE ADHESIVE TAPE DISPENSER

(71) Applicant: 3M INNOVATIVE PROPERTIES COMPANY, St. Paul, MN (US)

(72) Inventors: Andrew J. Hartgers, Ilderton (CA); Liam D. Rutherford, London (CA)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 259 days.

(21) Appl. No.: 18/694,098

(22) PCT Filed: Sep. 19, 2022

(86) PCT No.: PCT/IB2022/058837
§ 371 (c)(1),
(2) Date: Mar. 21, 2024

(87) PCT Pub. No.: WO2023/047265
PCT Pub. Date: Mar. 30, 2023

(65) Prior Publication Data

US 2024/0400334 A1 Dec. 5, 2024

Related U.S. Application Data

(60) Provisional application No. 63/247,370, filed on Sep. 23, 2021.

(51) Int. Cl.
*B32B 41/00* (2006.01)
*B65H 35/00* (2006.01)
*B65H 45/08* (2006.01)

(52) U.S. Cl.
CPC ..... *B65H 35/004* (2013.01); *B65H 45/08* (2013.01); *B65H 2301/512145* (2013.01); *B65H 2701/377* (2013.01)

(58) Field of Classification Search
CPC ..... B65H 35/004; B65H 45/08; B65H 2301/512145; B65H 2701/377;
(Continued)

(56) References Cited

U.S. PATENT DOCUMENTS 3,495,506 A 2/1970 Plymale
5,624,527 A * 4/1997 Maresh ..... B65H 35/0026 156/555
6,502,616 B1 * 1/2003 Row ..... B65H 37/06 156/465

FOREIGN PATENT DOCUMENTS

EP 1746060 A1 1/2007

OTHER PUBLICATIONS

International Search report for PCT International Application No. PCT/IB2022/058837, mailed on Mar. 3, 2023, 6 pages.

* cited by examiner

*Primary Examiner* — Michael N Orlando
*Assistant Examiner* — Joshel Rivera
(74) *Attorney, Agent, or Firm* — Kathleen B. Gross; Scott A. Baum

(57) ABSTRACT

A collapsed adhesive tape tube dispenser for dispensing adhesive tape rolls. The dispenser having a baseplate having a first end, a second end, and a baseplate center line extending longitudinally in the machine direction. A tape roll unwind supported by the baseplate near the first end. A mandrel extending in the machine direction having a mandrel first end and a mandrel second end with the mandrel second end being cantilevered and unsupported. An exterior forming die positioned between the first end and the second end, and the exterior forming die having a shaping portion with a threading slot. A compression roller located near the second end for flattening the adhesive tape tube structure.

20 Claims, 10 Drawing Sheets

(58) Field of Classification Search
CPC .. B65H 2301/51232; B65H 2701/1922; B65H 35/0026; B65H 37/06; B65H 16/005; B29C 53/48
USPC ..... 156/60, 64, 350, 351, 378, 379
See application file for complete search history.

HOLLOW TUBE ADHESIVE TAPE DISPENSER

CROSS-REFERENCE TO RELATED APPLICATION

This application is a national stage filing under 35 U.S.C. 371 of PCT/IB2022/058837, filed Sep. 19, 2022, which claims priority to U.S. Provisional Application No. 63/247,370, filed Sep. 23, 2021, the disclosure of which is incorporated by reference in its entirety herein.

BACKGROUND

Adhesive masking tape is frequently used in automotive assembly plants to paint two-tone automotive paint finishes. Dispensers to unwind a strip of adhesive tape for application to the car's body panels and/or frame are useful to speed up the painting process.

SUMMARY

In various instances, such as when holding down sealing masking films or on uneven/irregular surfaces, it can be useful to apply the masking tape to the automotive body panels or automotive frame as a flattened, tubular structure such that the circumference of the structure is adhesive material. This forms a "two-sided" adhesive tape structure. However, unlike a normal two-sided adhesive tape, the flattened tubular structure from the top to the bottom in cross-section has an adhesive surface, a backing layer, a non-adhesive center space, a backing layer, and another adhesive surface. Such a structure is formed by first forming a circular tube of the masking tape, adhesive side out, with an overlap seam where the first edge of the masking tape overlaps the second edge of the masking tape forming the seam. Thereafter, the formed circular tubular structure can be flattened by a compressive means and severed to the length needed for application to the car.

Tape dispensers used in automotive manufacturing operations need to be fast and easy to use; especially, when changing and threading up a new adhesive tape roll. They also need to be relatively insensitive to the type of adhesive tape used. Preferably for a tape dispenser dispensing flattened tubular structures, there is some adjustment to control the tape overlap and resulting seam width to control the final compressed tape width. Additionally, if the tape dispenser can optionally encase a wire, a reenforcing cord, or a removal string in the center space of the flattened tube additional benefits allow for adhering electrical wires to surfaces, reenforcing the structure, or for easier removal of the masking tape from the vehicle.

Hence, in one embodiment, the invention resides in a collapsed adhesive tape tube dispenser comprising: a baseplate having a first end, a second end, and a baseplate center line extending longitudinally in the machine direction; a tape roll unwind supported by the baseplate near the first end; a mandrel extending in the machine direction having a mandrel first end and a mandrel second end, the mandrel second end being cantilevered and unsupported; an exterior forming die positioned between the first end and the second end, the exterior forming die having a shaping portion with a threading slot; and a compression roller located near the second end.

In another embodiment, the invention resides in an adhesive tape structure comprising a collapsed tubular structure made from the adhesive tape, the collapsed tubular structure having a second edge overlapping a first edge forming a seam, a hollow center, and an encased secondary material located in the hollow center.

In another embodiment, the invention resides in a method of encasing a secondary material in a collapsed tubular structure comprising: placing a roll of adhesive tape in a tape unwind; placing a roll of secondary material in a secondary material unwind; feeding the adhesive tape around a mandrel and through an exterior forming die; feeding the secondary material through the mandrel and through the exterior forming die; wrapping the adhesive tape about the secondary material forming a tubular structure with a seam; and collapsing the tubular structure encasing the secondary material.

DETAILED DESCRIPTION

Figure 1:
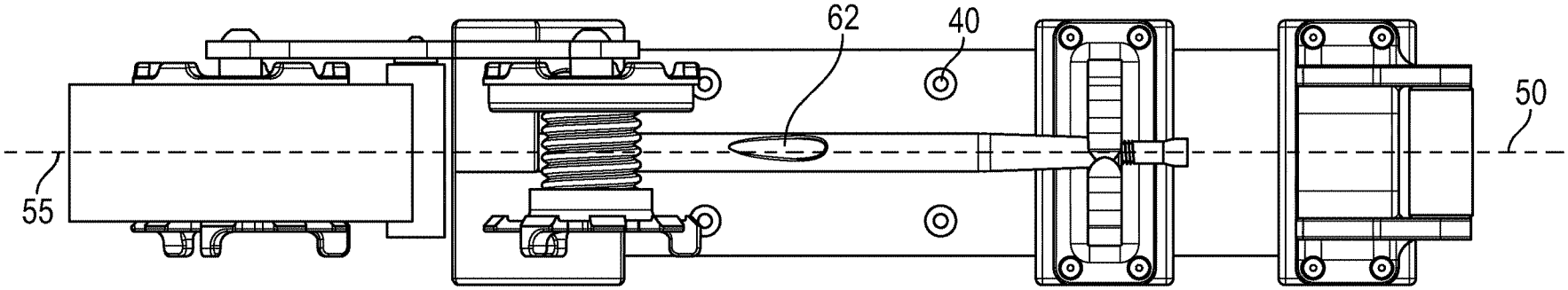
FIG. 1 is a top view of an adhesive tape dispenser.
Figure 2:
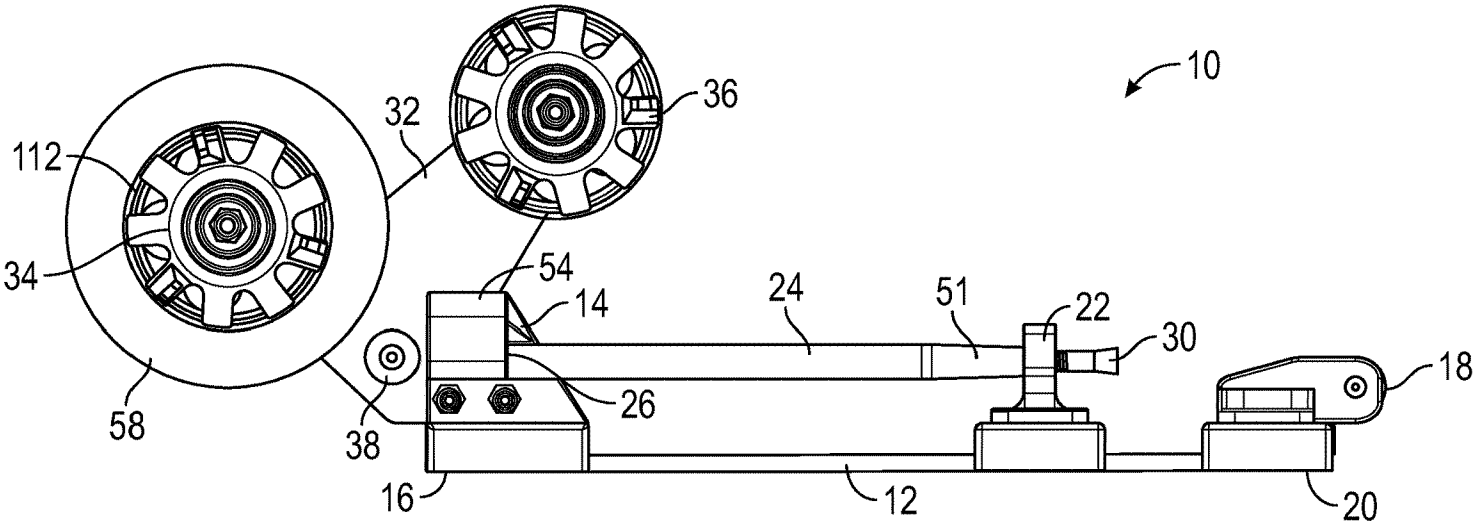
FIG. 2 is a side view of the adhesive tape dispenser.
Figure 4:
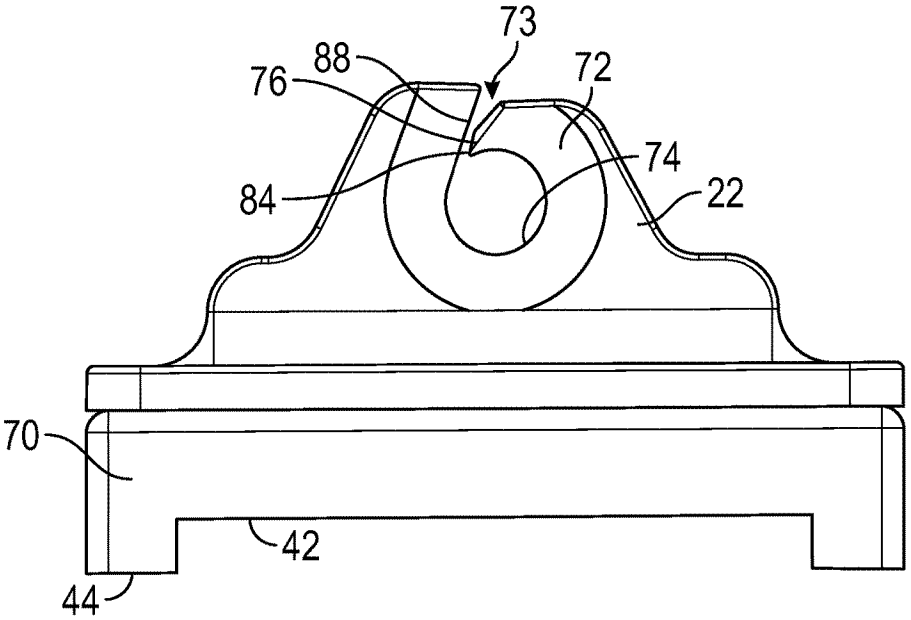
FIG. 4 is an end view of an external forming die.
Figure 3:
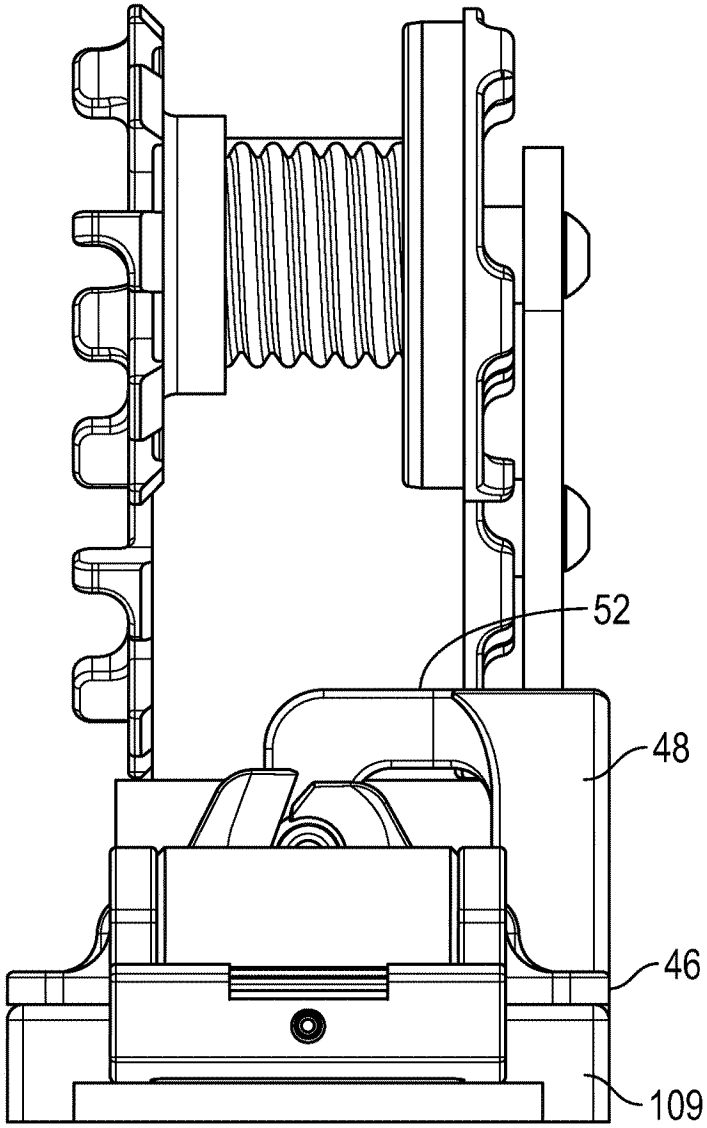
FIG. 3 is an end view of the adhesive tape dispenser.
Figure 5:
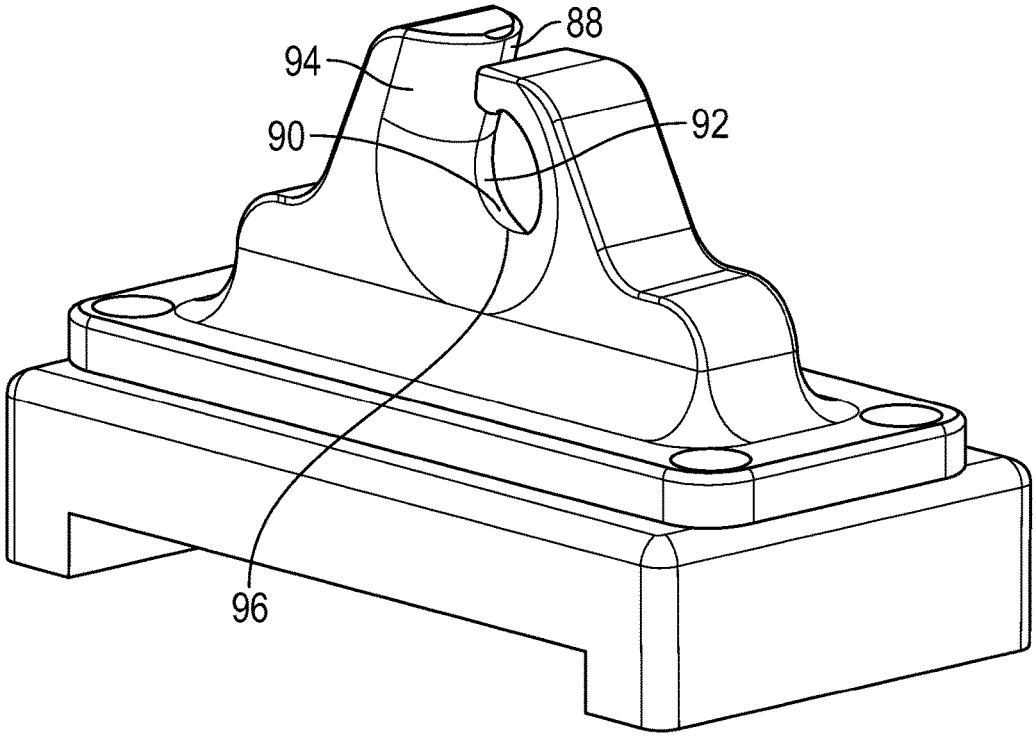
FIG. 5 is a perspective view of the external forming die.

Throughout this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" or "at least one of A or B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section.

The term "about" as used herein can allow for a degree of variability in a value or range. For example, within 10%, within 5%, or within 1% of a stated value or of a stated limit of a range and includes the exact stated value or range.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more, or 100%. The term "substantially free of" as used herein can mean having none or having a trivial amount of, such that the amount of material present does not affect the material properties of the composition including the material, such that the composition is about 0 wt % to about 5 wt % of the material, or about 0 wt % to about 1 wt %, or about 5 wt % or less, or less than or equal to about 4.5 wt %, 4, 3.5, 3, 2.5, 2, 1.5, 1, 0.9, 0.8, 0.7, 0.6, 0.5, 0.4, 0.3, 0.2, 0.1, 0.01, or about 0.001 wt % or less.

Referring to FIGS. 1-12, the tape dispenser 10 is illustrated. The tape dispenser includes a baseplate 12, a mandrel support bracket 14 located on a first end 16 of the baseplate, a compression roller 18 located on a second end 20 of the base plate, and a exterior forming die 22 located between the mandrel support bracket and the compression roller. A mandrel 24 is cantilevered and supported at a mandrel first end 26 by the mandrel support bracket 14. At a mandrel second end 28 an optional interior forming die 30 is attached to the mandrel second end. An unwind support plate 32 is attached to the mandrel support bracket 14 and has a tape roll unwind 34 bolted to the unwind support plate. The unwind support plate 32 and has provision for a secondary material roll unwind 36 for feeding a secondary material such as electrical wire, reenforcing cord, string, or any other material that can be unwound and encased by the adhesive tape tubular structure. A lead-in roller 38 is also attached to the unwind support bracket.

Baseplate

The baseplate 12 is typically made from an aluminum plate approximately ¼ inch thick by 3 inches wide and 14 inches in length. The choice of baseplate material and overall size can be adjusted as needed for the intended application and width of the adhesive tape in the tape unwind 34. A plurality of locating apertures 40 (holes or slots) are provided at various locations to bolt the various parts to the baseplate and to allow for the longitudinal linear position of the exterior forming die 22 to be changed in relation to the mandrel second end 28. For example, slots can be provided for the fasteners to attach the exterior forming die 22 to the baseplate 12 such that the linear position of the exterior forming die in relation to the mandrel 24 can be changed and the effective diameter of the mandrel in the exterior forming die changed by use of the optional taper present on the mandrel prior to the mandrel second end 28. The fastening apertures are countersunk on the bottom of the baseplate such that tapered machine screws do not protrude from the bottom surface. Threaded inserts, if needed, can be positioned in the various attachments to secure the individual attachment to the baseplate.

Mandrel Support Bracket

The mandrel support bracket 14 has a base 41 that spans the baseplate 10 with an optional channel 42 in the bottom surface 44. The channel 42 has a depth and a width to accommodate a slip fit to the baseplate 10 to prevent the mandrel support bracket from twisting relative to the baseplate. Extending vertically from a top edge 46 of the base 41 is a primary vertical support 48. The primary vertical support 48 holds the unwind support plate 32 that is bolted to it. Extending horizontally towards a baseplate centerline 50 from the primary vertical support 48 is a cross-machine horizontal support 52. Extending down towards the baseplate 10 is the mandrel vertical support 54. The centerline of the mandrel vertical support and mandrel 24 is aligned with the tape roll centerline 55. The mandrel vertical support 54 and the cross-machine horizontal support 52 are both cantilevered from the primary vertical support 48 such that adhesive tape 56 can enter an opening 57 between the mandrel vertical support 54 and the baseplate 10.

The mandrel 24, in one embodiment, is cantilevered such that it is supported by the mandrel first end 26 and the mandrel second end 28 is free and unsupported. The mandrel extends parallel to and above the baseplate centerline 50 from the mandrel vertical support 54 such that the tape roll centerline 55 of the adhesive tape roll 58 in the tape unwind 34 is aligned with the centerline of the mandrel in the cross-machine direction. The height of the mandrel is preferably adjusted such that the mandrel's bottom surface is tangent to or slightly below the bottom surface of the lead in roll 38. This is believed to start the adhesive tape to curl about the mandrel without undo drag. If the mandrel is positioned too high, the adhesive tape will miss a majority of the mandrel's length and may be forced to curl too rapidly going through the exterior forming die. If the mandrel is too low, the adhesive tape may not wrap the lead in roll 38 potentially leading to tape handling issues since the wrap on the lead in roll presents the adhesive tape in a flatten non-wrinkled orientation to the mandrel.

An inside surface 60 of the primary vertical support 48 can be curved towards the mandrel 24 (concave) to assist in rolling over the adhesive tape's edge in the event the adhesive tape tracks too far off the centerline.

Mandrel

A mandrel first end 26 is attached to the mandrel vertical support 54 by an external thread on the mandrel first end into a threaded bore. The mandrel 24 can be cantilevered from the mandrel vertical support 54 and has a length along the baseplate centerline 50 that is sufficient to allow the first edge of the tape to overlap the second edge without unduly stressing or wrinkling the adhesive tape or causing wrinkles to appear at the exterior forming die 22. The mandrel length needed will, to some degree, depend on the tape's thickness/stiffness to bending. Additionally, the length of the mandrel may need to be longer when a secondary material is encased and has to be threaded through a secondary material inlet.

For a 2 inch-wide adhesive masking tape, a 10 inch length was present between the center line of the lead in roll 38 to the centerline of the exterior forming die 22 when the mandrel extended through the exterior forming die; however, a distance of 9 inches or even 8 inches was also found to work. Note that the bottom edge of the mandrel vertical support 54 is also curved and can act as a mandrel extension extending the mandrel almost to the lead in roll 38. If the mandrel length becomes too short longitudinal wrinkles can form as the adhesive tape is pulled through the exterior forming die 22. The adhesive tape becomes "overworked" and is not allowed to fully curl or nearly fully curl before approaching the exterior forming die 22.

The mandrel 24 can optionally taper 51 prior to the mandrel second end 28. The optional taper can be used to help fine tune the resulting seam overlap; especially, if an interior forming die 30 is not used. Additionally, the optional taper can be used to maintain a specific clearance between the mandrel and the exterior forming die 22 which can be useful when switching between thicker or thinner adhesive tapes by moving the linear position of the exterior forming die in relation to the taper.

The mandrel 24 is preferably circular in cross-section but other shapes can be used such as U shaped, hexagon, polygon, and oval. Preferably at least a portion of the mandrel 24 is hollow or non-solid in cross section and a material inlet 62 is present allowing access to the hollow/non-solid portion. The material inlet 62 and hollow portion allow a secondary material 64 to be fed through the center of the mandrel and encased by the adhesive tape tubular structure 66 that is formed. The material inlet 62 can be elongated in the direction of the baseplate centerline 50 to prevent snagging and preferably has an internal ramp 68 to smoothly feed the secondary material 64 into the hollow portion. The material inlet's linear position along the mandrel should be prior to the adhesive tape completely encircling the mandrel and is preferably closer to the first end 26 than to the second end 28.

The diameter of the mandrel is sized to be stiff enough to enable it to be cantilevered. Instead of a uniform diameter, the mandrel can be tapered, and it can have a taper all the way to the first end 26 if needed for stiffness. Thus, the mandrel first end 26 can have a larger diameter than the second end 28. Preferably, the diameter of the mandrel is also sized to at least partially, if not fully, extend through the exterior forming die 22. Thus, the diameter of the mandrel at the second end 28 is a function of the adhesive tape width and resulting tape tube diameter once the first edge and the second edge of the adhesive tape are overlapped. The diameter of the mandrel at the second end 28 in this embodiment can be equal to or less than the interior diameter of the adhesive tape tube once it is formed and less than the diameter of the exterior forming die 22 so the second end 28 can pass through the exterior forming die 22 while still allowing for adequate clearance of the adhesive tape in the die's throat between the mandrel and the smallest diameter of the exterior forming die.

In another embodiment, the mandrel second end 28 can be positioned prior to the exterior forming die and a gap can be present between the mandrel second end 28 and the exterior forming die 22. This gap or open section can allow for a "taper" in the formation of the adhesive tape tube as it is drawn from the second end 28 through the exterior forming die 22. Thus, in this embodiment, the diameter of the second end 28 can be larger than, equal to, or smaller than the diameter of the exterior forming die 22.

Exterior Forming Die

The exterior forming die 22 has a base 70 for slidable attachment to the baseplate 12. The base may be one integral part or the two-part one shown. The forming die base 70 has an optional channel 42 in the bottom surface 44. The channel 42 has a depth and a width to accommodate a slip fit to the baseplate 10 to prevent the forming die base from twisting relative to the baseplate. The slip fit and slots in the baseplate allows the longitudinal position of the external forming die to be adjusted relative to the mandrel 24.

The shaping portion 72 of the exterior forming die resembles a number six "6" when viewed in the direction of the baseplate centerline 50. The shaping portion 72 has a threading slot 73 allowing access to the circular die 74. The circular die has an edge tuck portion 76 that curves one edge of the adhesive tape 56 under the other edge to establish an overlap amount 80 for the seam 82 in the tubular structure 66. The edge tuck 76 preferably has a terminal edge 84 or point that is located past 12 o'clock counterclockwise (when viewing the circular die as a clock face) to roll the first edge 83 of the adhesive tape 58 under the second edge 85. The edge tuck 76 preferably has a clearance chamfer 86 extending back from the edge tuck that allows the second edge 85 of the adhesive tape to overlap the first edge 83 without touching that chamfered edge of the circular die 74. The circular die 74 also has a linear lead in portion 88 before transitioning to a circular portion 90 that transitions to the edge tuck 76. The linear portion starts at approximately 1 o'clock and extends to approximately 9 o'clock. Additionally, the distal end of the linear lead in portion 88 extends higher in elevation than the edge tuck 76 to assist in overlapping the second edge 85 of the adhesive tape.

In one embodiment, the diameter of the circular portion is about 0.48 inch and the linear lead in portion is about 0.5 inches long for forming an approximately 0.48 inch diameter circular tubular adhesive tape structure with an approximately 0.4 inch overlap at the seam 82 with an adhesive tape that is approximately 2.0 inches wide on the roll.

Figure 9:
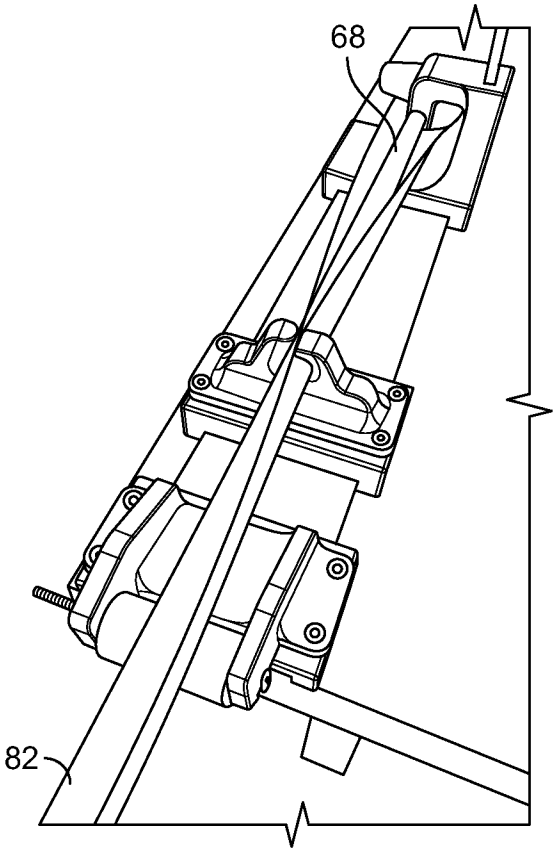
FIG. 9 is a perspective view of the tape dispenser in operation.

The linear lead in portion helps to easily thread the exterior forming die versus threading the adhesive tape, adhesive side out, through a curved threading slot. Additionally, as best seen in FIG. 9, the linear lead in portion allows the second edge of the adhesive tape to remain standing up after leaving the exterior forming die and not be firmly locked adhesively to the first edge in the seam until approximately reaching the compression roller. This can allow the collapsing tube structure to naturally stress relieve during the collapse prior to complete seaming without forming wrinkles. It is believed that a circular lead in portion would seam the edges more quickly, since they would be in close proximity after leaving the exterior forming die and be more prone to wrinkle generation between the exterior forming die and the compression roller as the tubular structure collapses.

Desirably the shaping portion 72 has a lead in chamfer 92 and a lead out chamfer 94 that join at a forming edge 96 that makes line contact with an adhesive side 98 of the adhesive tape 56. Since the adhesive of the tape is in contact with the shaping portion 72, it is desirable to minimize the contact area and resulting drag. Additionally, minimizing the contact area helps to reduce skewing and other tracking issues from the adhesive sticking to the shaping portion 72. Alternatively, the shaping portion 72 in the die's throat could have a convex surface with a small surface area contact to the adhesive side 98 instead of the preferred line contact illustrated.

At least a portion of the mandrel 24 is preferably inserted into the shaping portion 72. This helps to prevent premature collapse of the adhesive tube structure and helps to prevent wrinkles. Alternatively, the mandrel second end can stop just prior to the shaping portion and a gap can be present depending on the stiffness of the adhesive tape and resulting tubular structure.

Interior Forming Die

Figure 6:
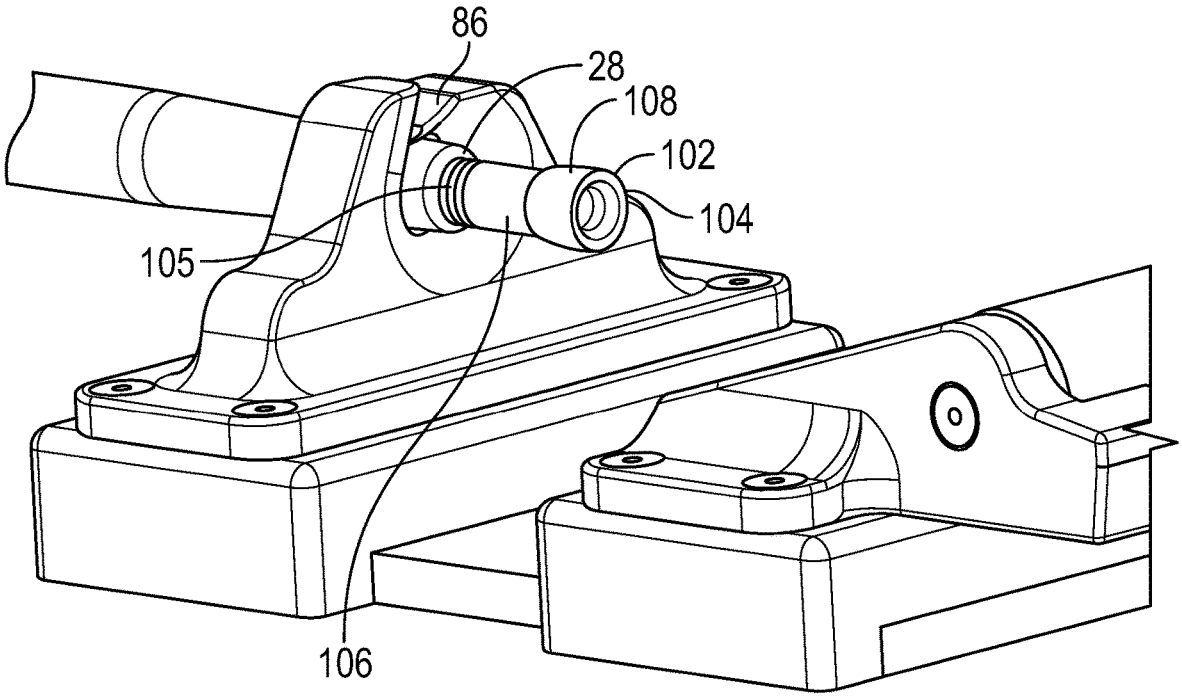
FIG. 6 is a perspective view of an internal forming die.
Figure 7:
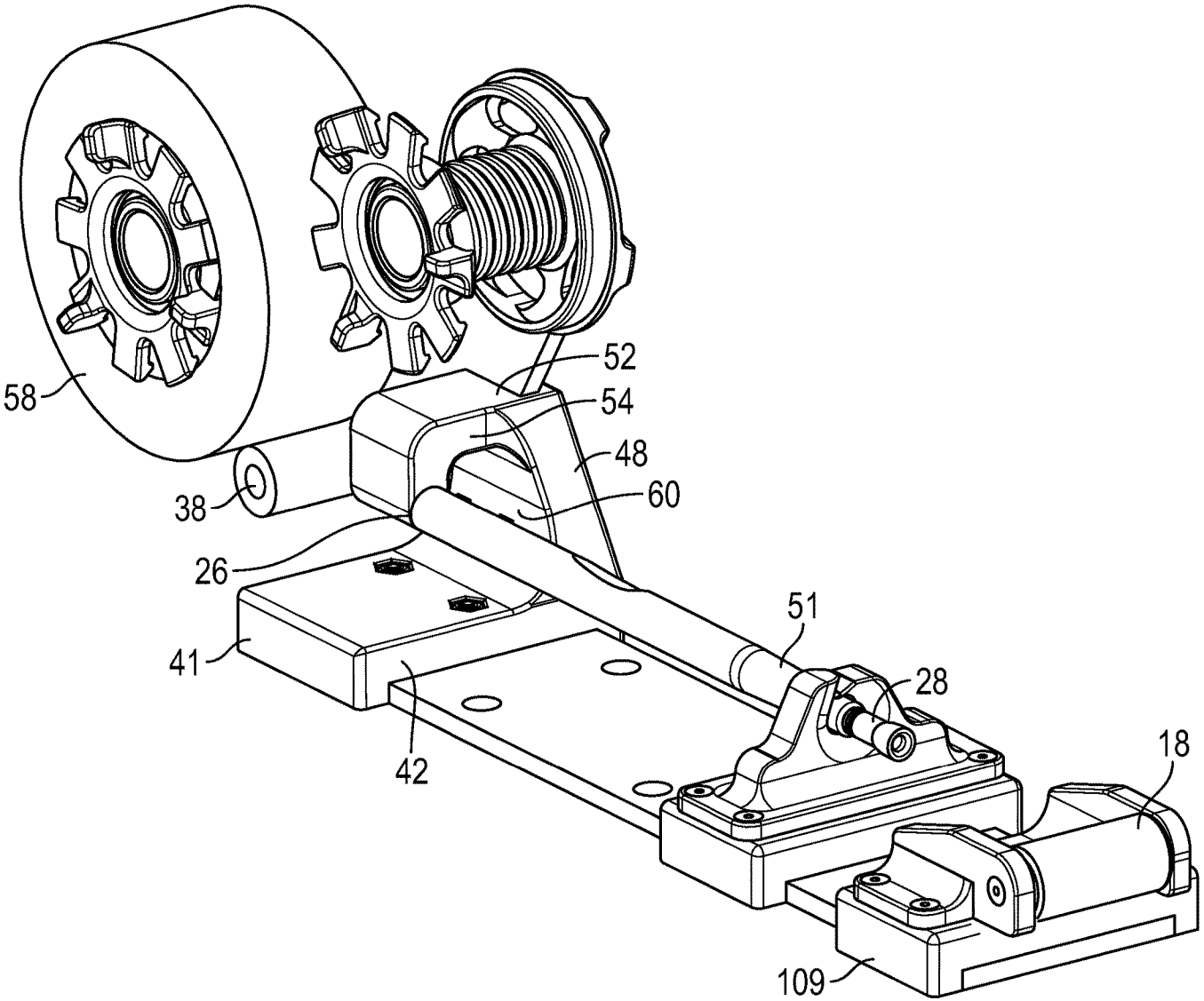
FIG. 7 is a perspective view of the adhesive tape dispenser.
Figure 8:
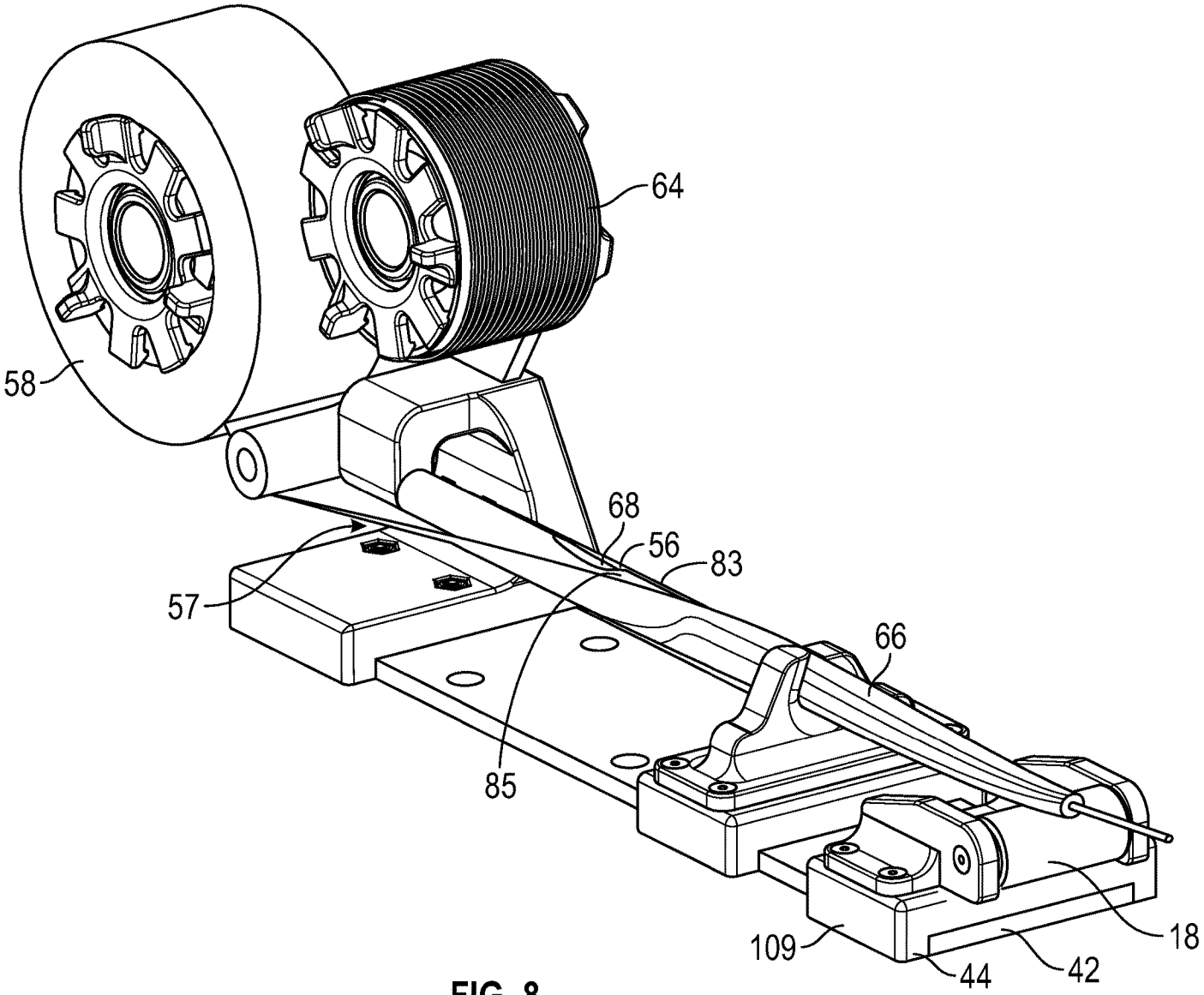
FIG. 8 is a perspective view of the adhesive tape dispenser forming a tubular tape structure encasing a wire in the center of the tube.
Figure 10:
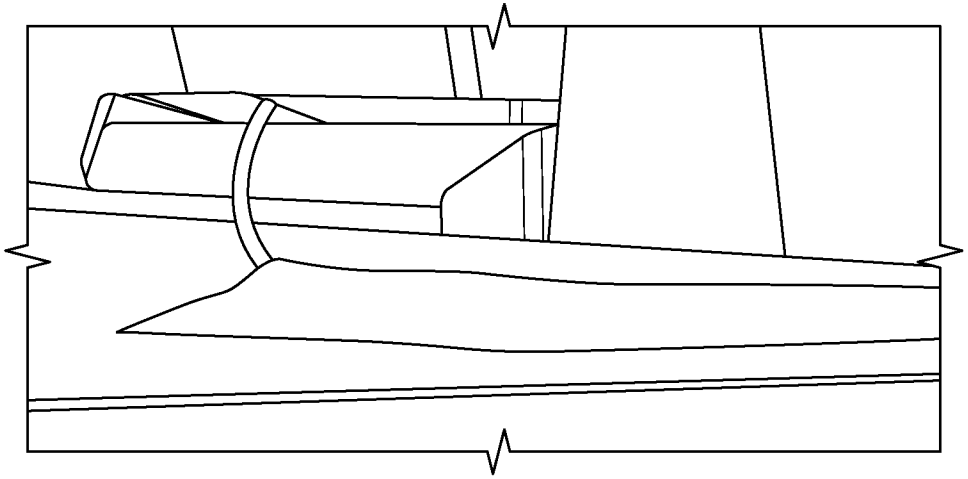
FIG. 10 is a side view of flattened tubular tape structure, adhesive side out, with a wire positioned in the hollow center.

The optional interior forming die 30 is used to fine tune the overlap 80 of the adhesive tape 56 and the resulting seam width. The backing side 100 of the adhesive tape 58 in the tubular structure 66 contacts the exterior surface 102 of the interior forming die. As best seen in FIG. 6, the machine direction position along the baseplate centerline 50 of the interior forming die 30 can be changed by screwing the interior forming die into or out of the mandrel second end 28. The second end of the mandrel is hollow and provided with a threaded bore (female) and the outside surface of the interior forming die opposite the distal end 104 is an exterior thread (male).

Without the interior forming die present, the first 83 and second 85 edges of the adhesive tape 56 would continue to overlap each other after traversing through the exterior forming die 22 until being locked into position by the compression roller 18 with the degree of overlap being a function of the machine direction distance between the compression roller 18 and the forming edge 96. Insertion of the interior forming die 30 serves to "open up the overlap" by virtue of the interior forming diameter 102 on the distal end 104 of the interior forming die. As such, the distance between the interior forming diameter 102 and the compression roller 18 can be changed thereby changing the resulting amount of overlap in the seam. Additionally, the diameter of the interior forming diameter can be changed to adjust the overlap. A larger diameter results in less overlap for a given width of adhesive tape. The interior forming diameter acts as a "course vernier" to change the overlap amount and the threaded linear positioning acting as a "fine vernier" when changing the overlap amount.

The interior forming die has an exterior threaded first end 105, a constant diameter portion 106 and an increasing taper portion 108 that terminates at the distal end 104 and the maximum size for the interior forming diameter 102. The interior forming die is preferably hollow or has a through bore to allow for the passage of the optional second material. Using an increasing taper again ensures line contact between the interior forming diameter 102 and the backing side 100 of the adhesive tape 58 helping to minimize skewing and steering issues.

For forming a tubular structure from 2-inch-wide adhesive tape, in one embodiment, the following dimensions were used: 0.39 inch for the interior forming diameter 102, 0.40 for the length of the taper portion 108, and the distal end 104 (in one particular threaded position) was located about 1 inch from the mandrel second end 28.

Compression Roller

The compression roller 18 serves to flatten the tubular structure 66 when the adhesive tape tubular structure is at least partially wrapped about the exterior surface of the compression roller since the tubular structure has very low compressive strength and collapses with the slightest amount of normal force generated by the tension acting on the roller's circumference. The slight wrap in combination with the tension also serves to lock the adhesive side 98 of the tape in the seam 82 to the backing side 100 of the tape in the seam.

The compression roller can be rotatably mounted to the baseplate 12 in an identical fashion to the mandrel support bracket 14 and exterior forming die 22 using a channel 42 in a bottom surface 44 of a compression roller base 109.

Preferably the compression roller is a wide roller with a smooth surface such that the tape does not touch supporting structures since the adhesive side of the tape faces outward and can cause the collapsed tubular structure to stick to objects easily. Another benefit to the wide roller when compared to the width of the collapsed tubular structure is the ability dispense the tape at a significant angle to the baseplate centerline 50 without touching other objects. This makes it easy for the operator to dispense the tape without pulling directly in line with the baseplate centerline.

The longitudinal centerline of the compression roller is located about 5 inches past the forming edge 96. Sufficient linear distance is provided to gently collapse the tubular structure after formation without creating wrinkles or bunching.

Figure 11:
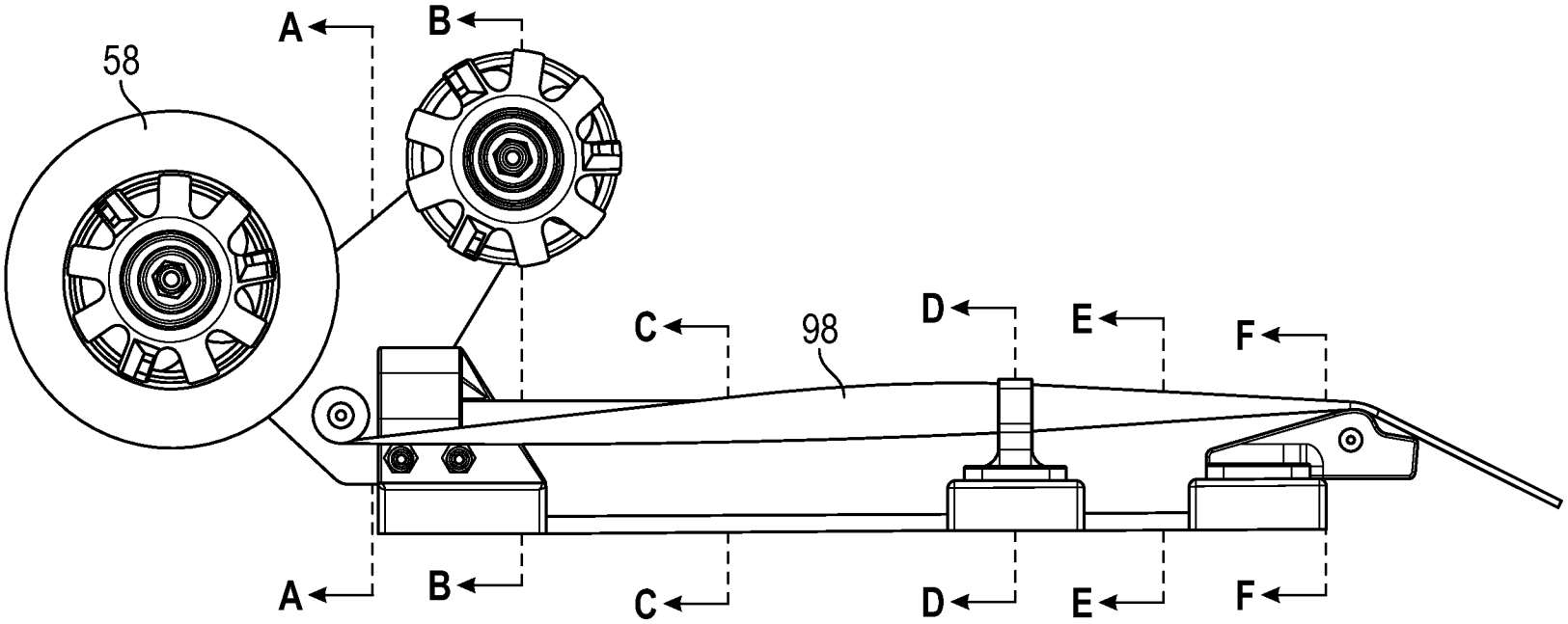
FIG. 11 is a side view of the adhesive tape dispenser forming a tubular structure with various cross sectional views taken where indicated.
Figure 11C:
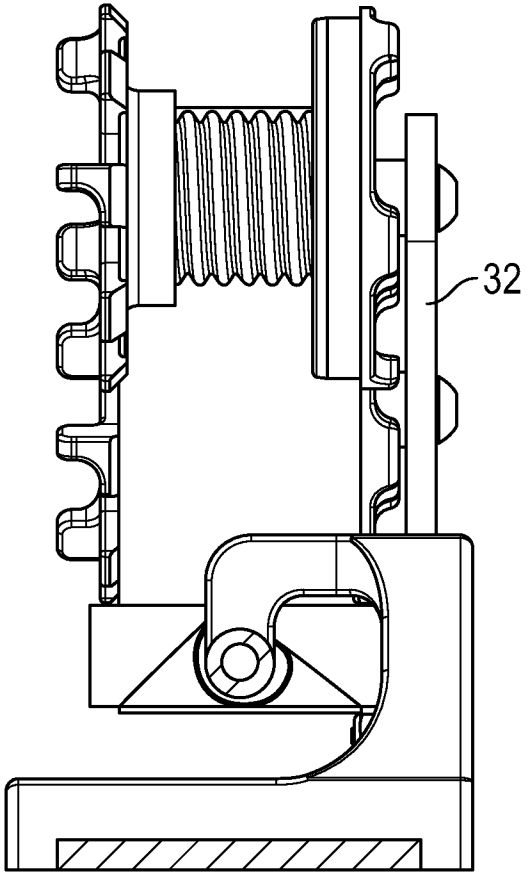
Figure 11B:
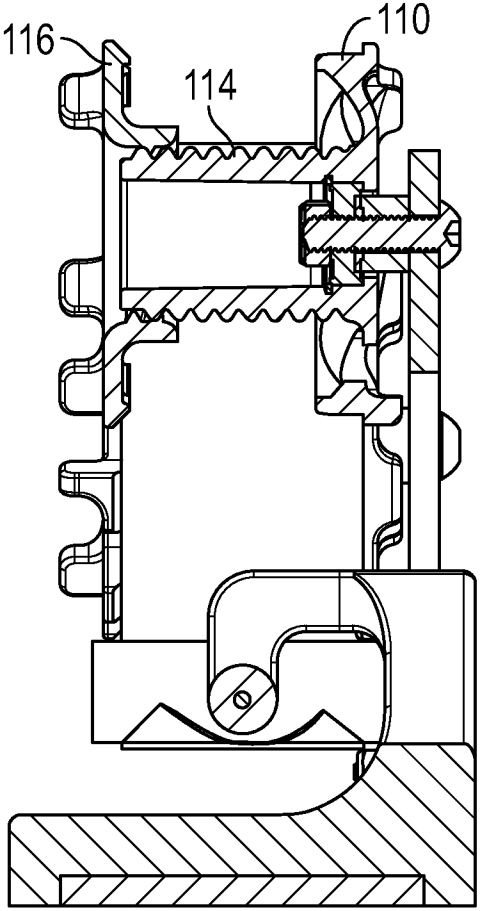
Figure 11A:
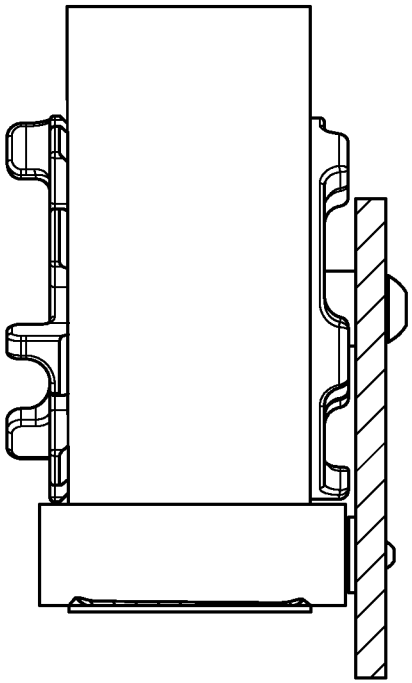
Figure 11F:
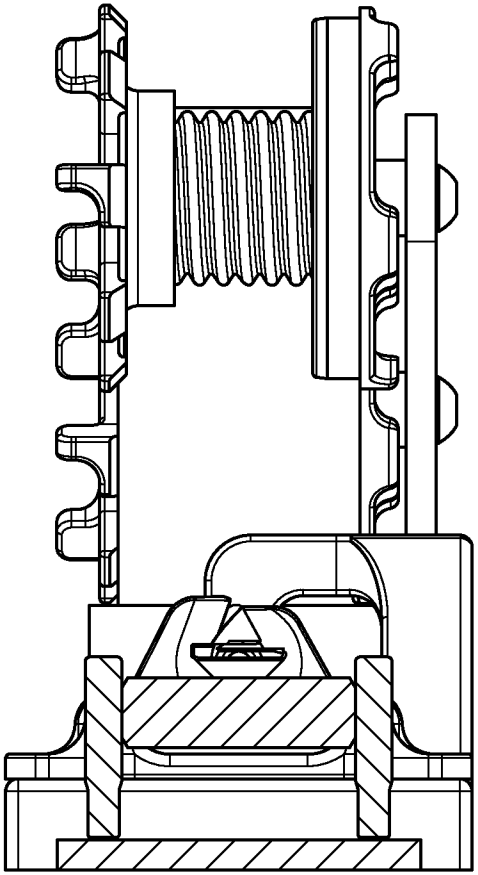
Figure 11E:
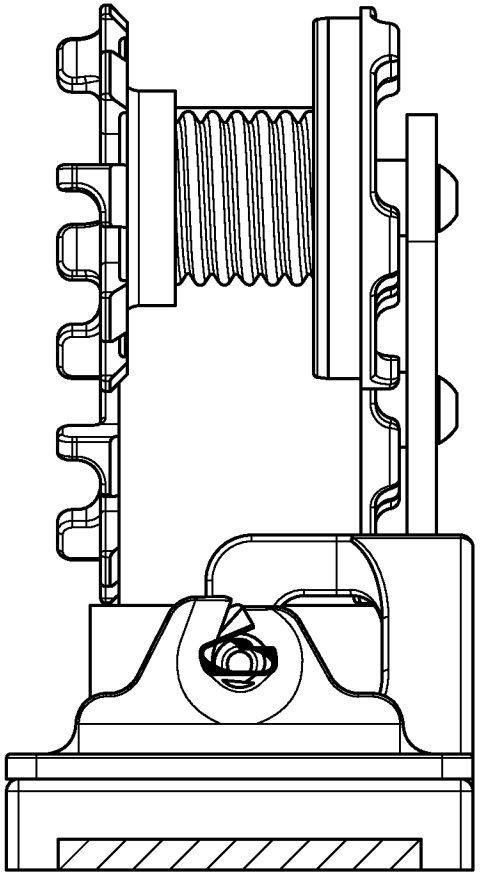
Figure 11D:
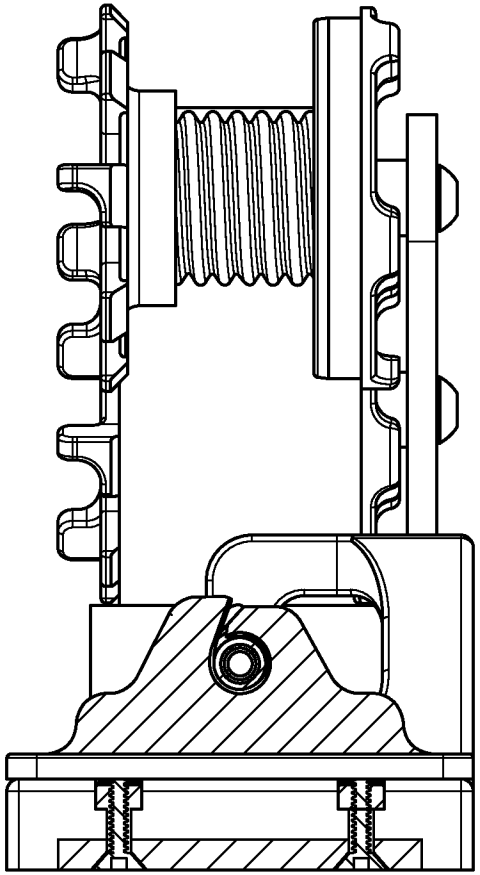
Figure 12:
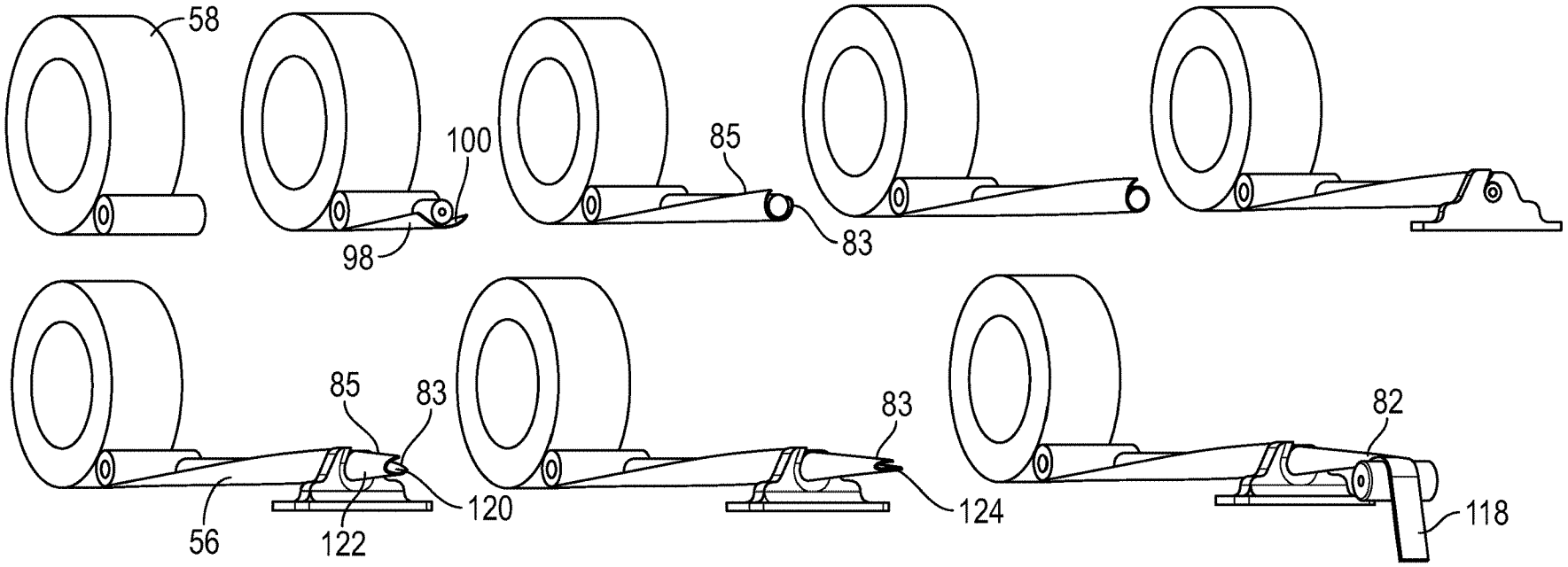
FIG. 12 are various perspective views of a web path for the adhesive tape as it proceeds though the adhesive tape dispenser.

Preferably the upper surface of the circumference of the compression roller is located at the same elevation from the baseplate as the center of the mandrel 24 and the center of the exterior forming die 22. The mandrel 24 is preferably concentric to the circular portion 90 of exterior forming die as well. By positioning the compression roller at this height, the collapsing angle the top and bottom sides of the collapsing tubular structure make with respect to a horizontal datum tangent to the upper surface of the roller and through the center of the mandrel will be the same as best seen in FIG. 11. If the upper surface of the compression roller is located either higher or lower than the center of the mandrel and the circular portion, the collapsing tubular structure will no longer be symmetric top to bottom as shown. Such a lack of symmetry can create undesirable distortions in the flattened tubular adhesive tape 118 as it is compressed by the wrap angle on the compression roller.

Other compressive means such as a nip, or a gap between opposing rollers can be used recognizing that the adhesive surface on the exterior may lead to undesired steering or contamination issues for elements that touch the adhesive surface. A single roller has the benefit of being easy to thread the dispenser.

Lead In Roller

The lead in roller 38 serves to guide the adhesive tape 56 onto the mandrel 24. The lead in roller 38 ensures a constant wrap of the adhesive tape 56 about the mandrel regardless of the adhesive tape roll 58 diameter as the adhesive tape is used up.

Preferably the lead in roller is positioned such that the mandrel's bottom surface is tangent to or slightly below the bottom surface of the lead in roll 38. This is believed to start the adhesive tape to curl about the mandrel without undo drag. The roller may be crowned or flat and a suitable diameter to fit into the adhesive dispenser.

Tape Unwind/Second Material Unwind

The tape unwind 34 and the second material unwind 36 have a locating collar 110 that is rotatably attached to the unwind support plate 32 for engaging the ID of a core 112 and positioning the adhesive tape roll in the correct cross-machine direction alignment. The locating collar 110 has an externally threaded spool 114 that is inserted into the core 112 and that a clamping collar 116 is threaded onto for clamping the core 112 between the two collars. The second material unwind 36 is positioned between the tape unwind 34 and the external forming die 22 to feed the second material into the material inlet 62. Optional unwind brakes can be employed but are often unnecessary due to sufficient drag being developed as the material flows though the tape dispenser. The unwinds are positioned to feed the adhesive tape 56 onto the lead in roller 38 and the secondary material 64 to the material inlet 62 without undue jogs or distortions in the respective web paths.

Method of Using

To use the tape dispenser 10 an adhesive tape roll 58 is inserted into the tape unwind 34 and, if desired, a secondary material roll is inserted into the secondary material unwind 36. A free end of the secondary material 64 on the secondary material roll is grasped and the roll unwound enough to insert the free end into the material inlet 62. The secondary material roll is then rotated to unwind the secondary material and advance it thorough the hollow portion of the mandrel 24 until the free end emerges from the mandrel and optional interior forming die 30 a sufficient distance to easily grasp.

A free end of the adhesive tape 56 is grasped and the free end wrapped underneath the lead in roller 38 and partially about the mandrel 24. Thereafter, the free end of the adhesive tape is threaded through the threading slot 73 until the adhesive tape free end is approximately even with the free end of the second material 64. Both free ends are then grasped and advanced over the compression roller 18 and wrapped at least partially around the compression roller.

Continuing to pull on the adhesive tape 56 and the secondary material 64 completely threads the tape dispenser 10 forming the tubular structure 66 encasing the secondary material 64 prior to being flattened by the compression roller 18. A sufficient length of material is advanced through the tape dispenser 10 and then severed to a suitable length by appropriate means such as a scissor, knife, shearing blade, etc. (not shown). Once severed, the flattened tubular tape structure can be applied where needed.

Encased Secondary Material

As discussed, the tape dispenser 10 has the ability to form a unique material for application to surfaces. The structure formed is a flattened tubular adhesive tape structure 118 with a hollow core 120 housing a secondary material 64. The flattened tubular adhesive tape structure has a seam 82 where a first edge 83 of the adhesive tape is overlapped by the second edge 85 of the adhesive tape adhesively securing the area adjacent the first edge to the area adjacent the second edge in the seam.

The flattened tubular structure has an external circumference 122 and an internal circumference 124. An adhesive is usually present on at least a portion of the external circumference to stick the flattened tubular structure to other surfaces. The degree of coverage of the adhesive on the external surface can vary from 0 to 100%. In some applications it can be desirable to simply sheave the secondary material (0% adhesive on the external surface) and only have adhesive in the seam 82 to hold the first and second edges (83-85) together. In other applications it is desirable to have 100% coverage of the external surface with adhesive so the structure acts like double-sided adhesive tape. In yet other applications it may be desirable to have 50% coverage of the external surface so one side of the flattened tubular structure is attachable to a surface while the other side remains free of adhesive. In yet other embodiments 0, 10, 20, 30, 40, 50, 60, 70, 80, 90, or 100% of the external circumference comprises an adhesive with suitable ranges between any of these values such as 90-100% adhesive coverage or 40-60% adhesive coverage.

An adhesive may or may not be present on at least a portion of the internal circumference. The degree of coverage of the adhesive on the internal circumference can vary from 0 to 100%. In some applications it can be desirable to simply sheave the secondary material (0% adhesive on the internal surface) and only have adhesive in the seam 82 to hold the first and second edges (83-85) together. In other applications it is desirable to have 100% adhesive coverage of the internal circumference so the sides of the flattened tubular structure stick to each other in the hollow core and secure the secondary material within the hollow core from moving. In yet other applications it may be desirable to have only partial coverage of the internal circumference to secure the secondary material to one side of the flattened tubular structure. In yet other embodiments 0, 10, 20, 30, 40, 50, 60, 70, 80, 90, or 100% of the internal circumference comprises an adhesive with suitable ranges between any of these values such as 0-10% adhesive coverage.

The adhesive on the internal and external circumferences may be applied uniformly to the surfaces, in lines, curvilinear lines, or stripes, or in patterns such as dots, discrete islands, or interrupted lines. The nature of the adhesive selected and the intended application will determine how the adhesive is applied to the backing layer prior to forming the tubular structure. Release agents in lines, dots, or areas can be incorporated onto the inner surface or outer surface as well.

Suitable secondary materials 64 can include electrical wire materials such as insulated wire, non-insulated wire, computer cables, and electrical ribbons. Reenforcing materials such as plastic or other string, cords, ropes, zip tie material, and reenforcing tape. Locating materials such as RFID sensors on a string, rope, or cord at specific intervals can also be used.

EXAMPLES

A tape dispenser having the dimensions as previously indicated above and made in accordance with the figures was tested with various 3M adhesive tapes.

In Example 1, the tape dispenser was set up with the following dimensions that could alter the seam overlap. The diameter of the circular portion 94 of the exterior forming die was 0.48 inch, the diameter of the interior forming diameter 102 was 0.39, and the distal end 104 of the interior forming die was located 1.2 inches from the forming edge 96 and 3.8 inches from the rotation axis of the compression roller 18.

As seen in Table 1 below, the tape dispenser was able to form a collapsed tubular dispensed structure that was overlapped and seamed together with 100% coverage of the exterior surface with adhesive even though the tape's adhesive properties varied significantly from 20-74 oz./inch and the tape's thickness varied from 1.9-8.5 mils. All the adhesive tapes tested had a nominal 2 inches wide width on the adhesive tape roll. The resulting overlap in the seam was measured to be from 8.5 to 10.6 mm without any adjust needed to the tape dispenser other than swapping out the adhesive tape in the tape unwind. As such, the performance of the tape dispenser was judged to be insensitive to changes in the incoming adhesive tape, which is a highly desirable trait.

TABLE 1

| Adhesive Tape | Seam Overlap (mm) | Tape Adhesion to Steel (oz./in.) | Tape Thickness (mils) |
|---|---|---|---|
| 3M Skived Film Tape 5480 | 10.6 | 20 | 3.7 |
| SCOTCH Performance Masking Tape 2380 | 10.3 | 39 | 7.2 |
| 3710 HIGHLAND Industrial Adhesive Tape | 8.5 | 40 | 1.9 |
| 3M Masking Tape 203 | 9.1 | 39 | 5.6 |
| 3M Duct Tape 2900 | 9.2 | 74 | 8.5 |

In Example 2, the diameter of the mandrel's taper, as measured at the forming edge 96, and the diameter of the circular portion 90 of the exterior forming die at the forming edge 96 were varied. For this test the optional interior forming die was not used. A 2 inches wide adhesive tape, 3M 203 Masking Tape, was dispensed and the resulting seam width was measured. The seam width reported in Table 2 is an average of five tests. As seen in Table 2, a circular portion 96 for the external forming die having a diameter from approximately 20 to 35% of the adhesive tape width worked if the mandrel diameter was also sized appropriately. In a preferred embodiment, the percentage was 24.4% with a 12.42 mm circular portion and an 11.17 mm mandrel diameter resulting in a 9.5 mm seam width.

TABLE 2

| Mandrel Diameter | Seam Width (Circular Portion 11.02 mm) | Seam Width (Circular Portion 12.42 mm) | Seam Width (Circular Portion 14.08 mm) | Seam Width (Circular Portion 15.5 mm) |
|---|---|---|---|---|
| 6.32 mm | 7.8 mm | 6.9 mm | 4.3 mm | no seam formed |
| 11.17 mm | mandrel too big | 9.5 mm | 5.0 mm | 1.7 mm |
| Circular Portion as a Percentage of Tape Width (Circular Portion ÷ 50.8 mm * 100) | 21.7% | 24.4% | 27.7 | 30.5% |

What is claimed is:

1. A collapsed adhesive tape tube dispenser comprising:

a baseplate having a first end, a second end, and a baseplate center line extending longitudinally in the machine direction;

a tape roll unwind supported by the baseplate near the first end;

a mandrel extending in the machine direction having a mandrel first end and a mandrel second end, the mandrel second end being cantilevered and unsupported;

an exterior forming die positioned between the first end and the second end, the exterior forming die having a shaping portion with a threading slot; and a compression roller located near the second end.

2. The collapsed adhesive tape tube dispenser of claim 1, wherein the mandrel tapers and a diameter of the mandrel second end is smaller than a diameter of the mandrel first end.

3. The collapsed adhesive tape tube dispenser of claim 1, wherein the mandrel comprises a material inlet and at least a portion of the mandrel is hollow such that a secondary material can be threaded through the material inlet, into the hollow portion, and out the mandrel second end.

4. The collapsed adhesive tape tube dispenser of claim 3, comprising a secondary material roll unwind supported by the baseplate near the first end.

5. The collapsed adhesive tape tube dispenser of claim 1, wherein the mandrel second end is positioned in or extends through the shaping portion.

6. The collapsed adhesive tape tube dispenser of claim 1, wherein the machine direction location of the exterior forming die between the first end and the second end is adjustable.

7. The collapsed adhesive tape tube dispenser of claim 1, wherein the shaping portion resembles a number "6" when viewed in the direction of the baseplate center line.

8. The collapsed adhesive tape tube dispenser of claim 1, wherein the shaping portion comprises a linear lead in portion and a circular portion that transitions to an edge tuck.

9. The collapsed adhesive tape tube dispenser of claim 1, wherein the shaping portion has a lead in chamfer and a lead out chamfer that make line contact at a forming edge.

10. The collapsed adhesive tape tube dispenser of claim 1, comprising an interior forming die inserted into the mandrel second end.

11. The collapsed adhesive tape tube dispenser of claim 10, wherein the machine direction location of the interior forming die between the first end and the second end is adjustable.

12. The collapsed adhesive tape tube dispenser of claim 11, wherein the mandrel second end comprises a threaded bore and the interior forming die comprises an exterior threaded first end.

13. The collapsed adhesive tape tube dispenser of claim 10, wherein the interior forming die comprises an increasing taper portion that terminates at a distal end at a maximum size of an interior forming diameter.

14. An adhesive tape structure comprising a collapsed tubular structure made from the adhesive tape, the collapsed tubular structure having a second edge overlapping a first edge forming a seam, a hollow center, and an encased secondary material located in the hollow center.

15. The adhesive tape structure of claim 14, wherein an external circumference of the collapsed tubular structure comprises 90% to 100% coverage of adhesive.

16. The adhesive tape structure of claim 14, wherein an external circumference of the collapsed tubular structure comprises 40% to 60% coverage of adhesive.

17. The adhesive tape structure of claim 14, wherein an internal circumference of the collapsed tubular structure comprises 0% to 10% coverage of adhesive.

18. The adhesive tape structure of claim 14, wherein the secondary material is selected from the group consisting of electrical wire materials, reinforcing materials, and locating materials.

19. A method of encasing a secondary material in a collapsed tubular structure comprising:

placing a roll of adhesive tape in a tape unwind;

placing a roll of secondary material in a secondary material unwind;

feeding the adhesive tape around a mandrel and through an exterior forming die;

feeding the secondary material through the mandrel and through the exterior forming die;

wrapping the adhesive tape about the secondary material forming a tubular structure with a seam; and collapsing the tubular structure encasing the secondary material.

20. The method of claim 19 wherein feeding the secondary material through the mandrel comprises feeding the secondary material through a material inlet in the mandrel and through a hollow portion of the mandrel.

* * * * *